United States Patent [19]

Sudnishnikov et al.

[11] 4,291,774

[45] Sep. 29, 1981

[54] ROCK-BREAKING IMPLEMENT FOR PERCUSSIVE MACHINES

[76] Inventors: Boris V. Sudnishnikov, Krasny prospekt, 56, kv. 59; Veniamin V. Kamensky, ulitsa Derzhavina, 19, kv. 78; Eduard P. Varnello, ulitsa Dzerzhinskogo, 3, kv. 19; Sergei K. Tupitsyn, ulitsa Zorge, 123, kv. 31, all of Novosibirsk, U.S.S.R.

[21] Appl. No.: 43,834

[22] Filed: May 30, 1979

[51] Int. Cl.[3] ..... E21C 13/08

[52] U.S. Cl. ..... 175/417

[58] Field of Search ..... 175/19, 323, 385, 389, 175/390, 391, 394, 395, 406–408, 412–420, 401

[56] References Cited

U.S. PATENT DOCUMENTS

| | | | |
|---|---|---|---|
| 1,387,733 | 8/1921 | Midgett | 175/385 |
| 1,580,254 | 4/1926 | Karns | 175/401 |
| 1,965,491 | 7/1934 | Curtis | 175/417 |
| 2,179,689 | 11/1939 | Earnheart | 175/415 |
| 2,519,861 | 8/1950 | Turner | 175/419 X |
| 2,971,594 | 2/1961 | Spencer | 175/401 X |
| 4,091,884 | 5/1978 | Thomas | 175/395 X |
| 4,144,941 | 3/1979 | Ritter | 175/390 |

FOREIGN PATENT DOCUMENTS

| | | | |
|---|---|---|---|
| 450789 | 10/1930 | Fed. Rep. of Germany | 175/390 |

*Primary Examiner*—James A. Leppink

*Attorney, Agent, or Firm*—Fleit & Jacobson

[57] ABSTRACT

A rock-breaking implement, preferably for a self-propelled percussive machine for driving boreholes, having a body, at least a part of the body facing the borehole faces being cylindrical in shape. The body is provided with rock-breaking wedges which are arranged in such a manner that their blades extend radially at the end face of the body. The body has grooves opening outside to the periphery of the body and designed to remove broken rock, the grooves extending along helical lines and intersecting one another so that portions of the body located between the intersecting grooves define the rock-breaking wedges. Edges of said wedges which extend on the periphery of the body within the cylindrical part thereof define a continuous circle when projected to the plane of transverse section of the body and are designed for forming the walls of the borehole.

13 Claims, 11 Drawing Figures

ROCK-BREAKING IMPLEMENT FOR PERCUSSIVE MACHINES

The invention relates to machines for driving boreholes in rocks, and more particularly, to rock-breaking implements for self-propelling percussive machines for driving boreholes.

The invention may be most peferably used for driving boreholes in low-strength rocks, such as coal.

The rock-breaking implement according to the invention may be used in the mining industry and construction, as well as for applications where it is required to drive a borehole in a confined location, where the use of conventional rock-breaking implements with cumbersome drilling rigs is impossible.

At present, rotary and percussion-rotary drilling rigs are widely used for driving boreholes in rocks, comprising a rock-breaking implement, a rotary drive to apply an axial force to the rock-breaking implement, and a drill string. Such drilling rigs have large size and heavy weight, and feature high cost.

The use of such drilling rigs is, however, hampered, if possible at all, under confined mining conditions in mining thin ore layers. In this connection, there was a long felt need to provide a machine of a new type for borehole driving.

One of such machines is a self-propelled percussive machine for driving boreholes in low-strength rocks. The machine has a casing with a rock-bearing implement and a hammer piston movable in the casing. The machine is also provided with an air supply pipe and a flexible hose for feeding compressed air to the machine to actuate the hammer piston. The machine is air driven and is caused to move in rock mass owing to the hammer piston imparting blows from the interior to the front end part of the casing. The main distinctive feature of the machine compared to conventional drilling rigs resides in the absence of conventional assemblies of the drilling rigs-rotary drive, special arrangement for applying an axial force to the rock-breaking implement, and drill string.

The machine is capable of making round boreholes without rotating or turning the rock-breaking implement, owing to its advance within rock mass.

The above-described percussive machine enables the borehole driving under very confined conditions owing to the fact that in view of its operating principle, it has small size and low weight. This makes the machine especially valuable for operation in the mines. Such machine is disclosed, e.g. in U.S. Pat. No. 3,942,595 granted to the Applicant.

However, with machines of this type using only percussive action to break the rock, there is the need to provide a special rock-breaking implement for such machines. The majority of conventional rock-breaking tools are designed to be used for percussion-rotary or rotary destruction of rock.

Thus, known in the art are rock-breaking implements or drill-crowns for percussion-rotary machines for driving boreholes in hard rocks. The drill crown comprises a body, rock-breaking wedges having radially extending blades at the end of the body facing the borehole face. Lateral sides of the wedges which define a part of the periphery of the drill crown are inclined at an angle from 2° to 5° to the borehole wall in operation. Grooves are provided between the rock-breaking wedges to remove broken rock from the borehole face. (Cf. USSR Inventor's Certificate No. 325,370, cl. 21c, 13/06).

This drill crown is usually employed for driving boreholes in hard rocks and, apart from an impact impulse, requires an application thereto of a torque and an axial force pressing it to the face which substantially complicates the overall design of the machine for driving boreholes.

The use of such crown in a self-propellled percussive machine without a rotary drive would be inefficient.

It is an object of the invention to provide a rock-breaking implement for a self-propelled percussive machine.

The invention resides in that in a rock-breaking implement preferably for a self-propelled percussive machine for driving a borehole, comprising a body having rock-breaking wedges, the wedge blades extending radially at one end face of the body, the rock-breaking wedges being separated from one another by grooves provided in the body and opening outside to the periphery of the body for removing broken rock, according to the invention, at least a part of the body facing the borehole face is cylindrical in shape, and the grooves extend along helical lines and intersect one another in such a manner that portions of the body located between the intersecting grooves define said rock-breaking wedges, whereof edges extending on the periphery of the body within the cylindrical part thereof will define a continuous circle when projected to the plane of transverse section of the body, and being designed for forming the borehole walls.

The use of the invention enables the driving of a round borehole in low-strength rocks, such as in coal, under confined mining conditions.

The rock-breaking implement according to the invention, owing to a special shape of the rock-breaking elements, imparts to the machine for which it is intended such valuable qualities as small size and light weight, high reliability and effectiveness. Cumbersome and costly drilling rig having a rotary drive may be thus dispensed with.

In the rock-breaking implement, each rock-breaking wedge is preferably formed by two grooves extending along lefthand and righthand helical lines with an equal pitch.

This distinction provides symmetrical rock-breaking wedges in the rock-breaking implement according to the invention, which exhibit high strength and allow a borehole to be driven in low- and medium-strength rocks.

In the rock-breaking implement according to the invention, each rock-breaking wedge may be defined by grooves extending along similar hand helical lines having different pitches.

This construction of the rock-breaking implement enables an improvement of accuracy in driving boreholes in rocks.

The rock-breaking implement is preferably provided with additional wedges, each being defined by mutually inclined intersecting grooves beyond the points of their intersection, looking away from the borehole face, extending between the rock-breaking wedges.

This construction of the rock-breaking implement enables an improved drilling speed owing to lower resistance offered by particles of broken rock in passages for their removal.

In the rock-breaking implement according to the invention, the end of the body having rock-breaking wedges may be provided with a rock-breaking rod extending axially at this end.

This feature protects the rock-breaking implement against damages in cases very hard inclusions are met on the path thereof in the borehole.

Passages for blasting the face of a borehole are preferably provided in the body of the rock-breaking implement.

This construction of the rock-breaking implement enables an improvement of the borehole drilling speed and prevents the implement from clogging in operation.

The invention, therefore, provides a rock-breaking implement for a self-propelled percussive machine for driving round boreholes in low-strength rocks under confined mining conditions, with high accuracy, the implement exhibiting high strength and reliability in operation and low resistance to the movement of broken particles of rock in the passages thereof for removing the broken rock from the borehole face.

The invention will now be described with reference to specific embodiments thereof illustrated in the accompanying drawings, in which.

A specific narrow terminology is used in the description of embodiments of the invention illustrated in the accompanying drawings. It is, however, to be born in mind that each term implies all equivalent elements functioning in similar manner and used to solve similar problems.

Figure 1:
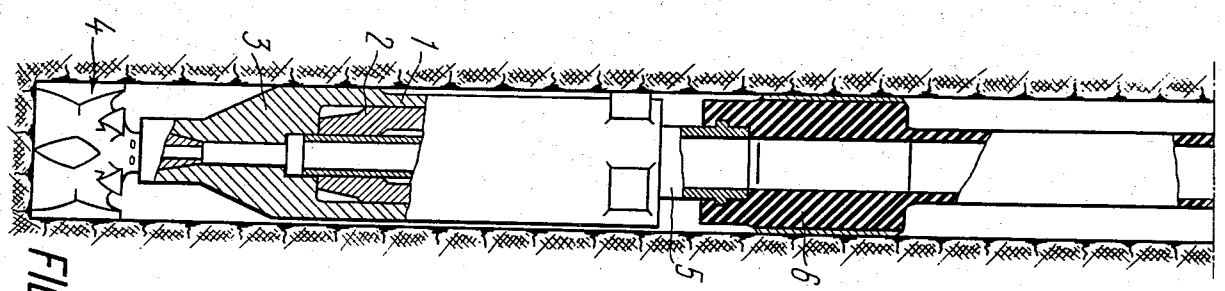
FIG. 1 is a front elevation, partially in section, of a rock-breaking implement according to the invention, which is installed on a self-propelled percussive machine for driving boreholes.

A self-propelled percussive machine for driving boreholes in low-strength rocks, such as coal, shown in FIG. 1, has a casing 1 accommodating a hammer piston 2. The hammer piston 2 which reciprocates under the action of compressed air pressure imparts, via a front end part 3 of the casing 1, impact impulses to a rock-breaking implement 4 mounted on the casing (impact impulses may be directly imparted to the rock-breaking implement).

A top part 5 of the machine incorporates an arrangement 6 preventing the machine from moving away from the borehole face during operation, the arrangement being radially yieldable and having its inner space in permanent communication with a compressed air mainline.

Figure 2:
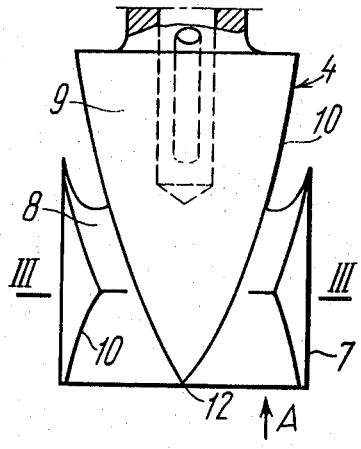
FIG. 2 is a front elevation, partially in section of a rock-breaking implement according to the invention.
Figure 3:
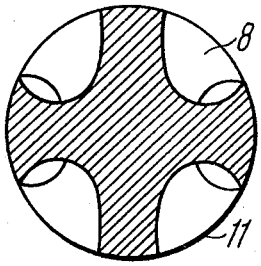
FIG. 3 is a sectional view taken along the line III—III in FIG. 2.
Figure 4:
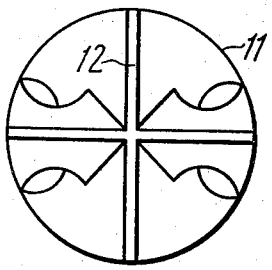
FIG. 4 is a view taken along arrow "A" in FIG. 2.
Figure 5:
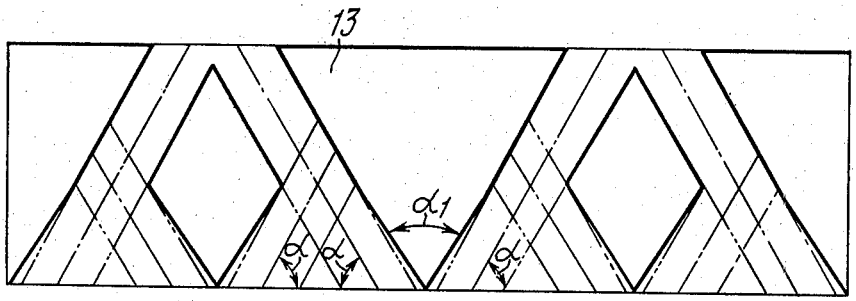
FIG. 5 is a developed view of the outer surface of the cylindrical part of the body of the rock-breaking implement shown in FIG. 2.

The rock-breaking implement 4 of the self-propelled percussive machine for driving boreholes in low-strength rocks, such as coal, shown in FIG. 2, comprises a body 7 having the outer surface, which in at least a part thereof facing the borehole face is cylindrical. The body 7 has grooves 8 for removing broken rock from the borehole face, which extend along helical lines opening outside to the outer cylindrical periphery of the body 7. The grooves 8 intersect one another in such a manner that portions of the body 7 located between the intersecting grooves 8 define rock-breaking wedges 9 designed for breaking the borehole face. Intersections of the outer cylindrical periphery of the body 7 with the surfaces of the grooves 8 define edges 10 of the rock-breaking wedges 9. The edges 10 provided within the cylindrical part of the body 7 will define a continuous circle 11 (FIG. 3) when projected to the plane of transverse section of the body 7 and are designed to form the borehole walls as they comprise cutting edges extending along the circle 11 in the overlapping relationship to one another. The wedges 9 for breaking the rock have radially extending blades 12 (FIG. 4) facing the borehole face. The wedges 9 have a wedge angle $\alpha_1$ (FIG. 5).

The rock-breaking implement of the self-propelled percussive machine for driving boreholes, shown in FIG. 2, functions in the following manner.

When compressed air is fed to the machine the arrangement for preventing the machine from moving away from the face (FIG. 1) engages the borehole wall or the wall of a starting case (when the machine is started outside the borehole).

At the same time, the hammer piston 2 starts reciprocating under the action of compressed air in the casing 1 of the machine and imparts impact impulses to the rock-breaking implement 4 mounted on the front end part 3 of the casing 1, or directly to the end face of the rock-breaking implement 4 mounted for movement in axial direction. Upon receiving the impact pulses, the rock-breaking implement penetrates, with its wedges 9, the surface of the borehole face and breaks the rock.

After the rock is thrust-out by the wedges 9 (FIG. 2), the cutting edges 10 start operating to form the cylindrical part of the borehole during their advance ensured by the percussive machine. The cylindrical shape of the borehole is ensured owing to the fact that the outer surface of the part of the body 7 facing the borehole face is cylindrical in shape, and the cutting edges 10 extend within this surface to define the continuous circle 11 (FIG. 3) when projected to the plane of transverse section of the body 7.

Broken rock is removed from the borehole face along the grooves 8 by self-displacement or in combination with the action of compressed air (air and water mixture) fed to the face zone. The wedges 9 for breaking rock have a wedge angle $\alpha_1$ (see FIG. 5).

The use of the rock-breaking implement 4 (FIG. 1) according to the invention in combination with the self-propelled percussive machine for driving boreholes ensures the driving of deep boreholes in low-strength rocks without the employment of a special rotary drive for rotating the implement in operation. This feature makes the self-propelled percussive machine for driving boreholes reliable in operation, small in size and light in weight.

FIG. 5 is a developed view of the outer surface of the cylindrical part of the body of the rock-breaking implement 4 of the self-propelled percussive machine for driving boreholes, shown in FIG. 2.

This developed view shows the construction of symmetrical wedges 13 (FIG. 5) for breaking rock, which are formed by the grooves 8 extending along lefthand and righthand helical lines having an equal pitch $\alpha$. The operation of these wedges 13 is similar to that of the wedges shown in FIG. 2.

This construction of the wedges 13 ensures their high strength and prolonged service life.

Figure 6:
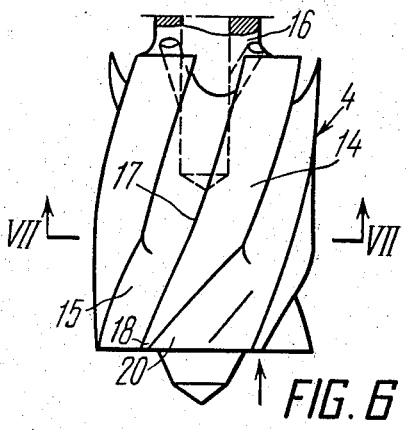
FIG. 6 is a front elevation of an embodiment of the rock-breaking implement.

FIG. 6 shows an embodiment of the rock-breaking implement of a self-propelled percussive machine for driving boreholes according to the invention, in a front elevation, partially in section.

Figure 7:
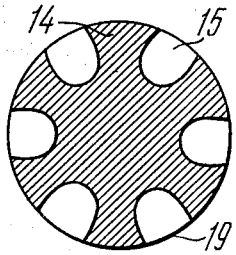
FIG. 7 is a sectional view taken along the line VII—VII in FIG. 6.
Figure 9:
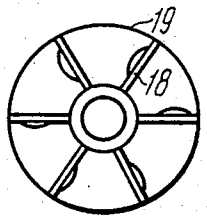
FIG. 9 is a view taken along the arrow in FIG. 6.
Figure 8:
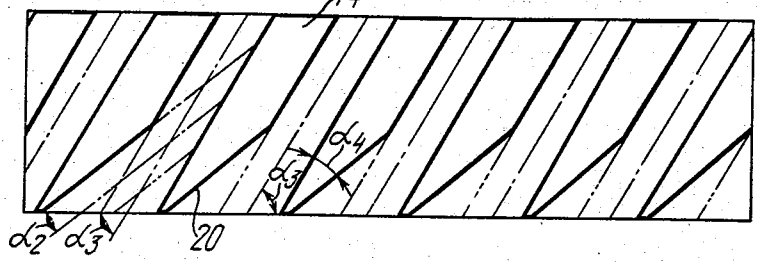
FIG. 8 is a developed view of the outer surface of the cylindrical part of the body of the embodiment of the rock-breaking implement shown in FIG. 6.

This embodiment of the rock-breaking implement, which was referred to above at 4 in FIG. 1, differs from that shown in FIG. 2 in that each rock-breaking wedge 14 (FIGS. 6 and 7) is formed by grooves 15 extending along similar hand helical lines (FIG. 8), the helical lines having different pitches $\alpha_2$ and $\alpha_3$ relative to a plane extending through the transverse section of a body 16 (FIG. 6). Intersection of the grooves 15, extending along the helical lines, with the outer cylindrical periphery of the body 16 defines edges 17 which comprise cutting edges. In addition, this intersection of the grooves 15 also defines blades 18 (FIG. 9) of the rock-breaking wedges 14 (FIG. 6) which extend radially at the end face of the body 16 facing the borehole face.

The edges 17 are so constructed that when projected to the plane of transverse section of the body 16 they define a continuous circle 19 (FIG. 7) so as to be capable of forming circular walls of the borehole.

The rock-breaking wedges 14 have lateral sides 20 (FIG. 8) defined by the grooves 15 extending along the helical lines and by the sides of the blades 18 at a wedge angle $\alpha_4$.

The rock-breaking implement of the self-propelled percussive machine for driving boreholes, shown in FIGS. 6 through 9, functions in the following manner.

Upon receiving an impact impulse from the hammer piston 2 (FIG. 1) of the machine, the rock-breaking implement 4 penetrates, with its wedges 14 (FIG. 6), the face rock to break it. After first impact impulses received by the rock-breaking implement 4, a cavity is formed in the borehole face. After the cavity exceeds the cross-sectional area of the borehole face, the cutting edges 17 (FIG. 6) start operating to form a circular cross-section of the borehole as they advance axially relative to the machine. During further penetration of the rock-breaking implement 4 into the rock, the implement is self-rotated at a pre-set speed about its axis owing to reaction forces developed at the lateral sides 20 of the wedges 14 during their engagement with the rock.

The use of this rock-breaking implement enables an improved accuracy of borehole driving in case one of the rock-breaking wedges 14 is broken.

Figure 10:
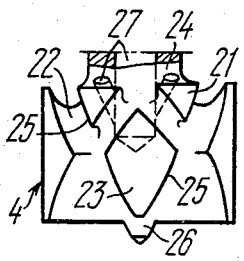
FIG. 10 is a front elevation of another embodiment of the rock-breaking implement.

FIG. 10 shows another embodiment of the rock-breaking implement of a self-propelled percussive machine for driving boreholes, according to the invention in a front elevation, partially in section.

Figure 11:
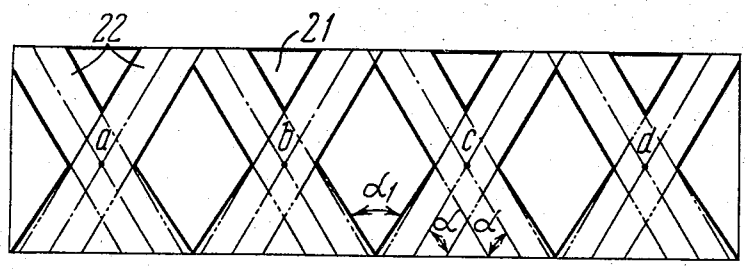
FIG. 11 is a developed view of the outer surface of the cylindrical part of the body in the embodiment of the rock-breaking implement shown in FIG. 10.

This rock-breaking implement generally referred to above at 4 in FIG. 1 differs from the implement 4 shown in FIG. 2 by the provision of additional wedges 21 (FIG. 10). The wedges 21 are defined by mutually inclined intersecting grooves 22 (FIG. 10) beyond their intersection points, a, b, c, d (FIG. 11) away from the borehole face. The wedges 21 (FIG. 10) form a rear row relative to the front row of wedges 23 for breaking rock. The wedges 21 are arranged between the rock-breaking wedges 23 when looking at the end face of a body 24. When edges 25 of all wedges 21 and 23 are projected to the plane of transverse section of the body, a continuous circle is obtained which is similar to the circles shown in FIGS. 3 and 7. This arrangement of the edges 25, which are cutting edges, similarly to the embodiments of the rock-breaking implement shown in FIGS. 2 and 6, enables the formation of a round borehole as a result of their advance along the axis of the machine.

This embodiment of the rock-breaking implement 4 functions mainly similarly to the rock-breaking implement described with reference to FIG. 2.

The distinctive feature in operation of this rock-breaking implement 4 resides in that the wedges 23 cannot completely form the wall of a round borehole. Final formation of the round borehole wall is effected by the wedges 21 breaking-off the part of the rock which remains in the half-broken form on the borehole wall.

The use of this rock-breaking implement enables the reduction of the total resistance offered to the movement of rock particles in the grooves 22 provided for this purpose. The clogging of the grooves 22 is thereby prevented, thus resulting in an increase in the driving speed.

In all above-described embodiments of the rock-breaking implement according to the invention, the end faces of the body having rock-breaking wedges may be provided with axially extending rock-breaking rods 26 (e.g. as shown in FIG. 10). The use of such rods is advantageous in driving boreholes with the rock-breaking implement in rocks having inclusions harder than the base rock.

Moreover, in all embodiments of the rock-breaking implement, passages 27 are preferably provided (FIG. 10) for feeding compressed air or air and water mixture to the face zone to prevent the helical grooves from clogging.

What is claimed is:

1. A rock-breaking implement, preferably for a self-propelled percussive machine for driving boreholes, comprising a body whereof at least a part facing a borehole face is cylindrical in shape:

rock-breaking wedges on said body arranged in such a manner that blades of the wedges extend radially at an end face of said body facing the borehole face;

grooves in said body which open outside to the periphery of said body to remove broken rock, said grooves extending along helical lines and intersecting one another in such a manner that portions of said body located between said intersecting grooves define said rock-breaking wedges;

edges of said rock-breaking wedges, which extend on the periphery of said body within the cylindrical part thereof defining a continuous circle when projected to a plane of transverse section of said body and forming walls of the borehole.

2. A rock-breaking implement according to claim 1, wherein passages for blasting the borehole face are provided in said body.

3. A rock-breaking implement according to claim 1, wherein the end face of said body having rock-breaking wedges is provided with an axially extending rock-breaking rod.

4. A rock-breaking implement according to claim 3, wherein passages for blasting the borehole face are provided in said body.

5. A rock-breaking implement according to claim 1, wherein each of said rock-breaking wedges is defined by grooves extending along similar hand helical lines having different pitches.

6. A rock-breaking implement according to claim 5, wherein the end face of said body with rock-breaking wedges is provided with an axially extending rock-breaking rod.

7. A rock-breaking implement according to claim 5, wherein passages for blasting the borehole face are provided in said body.

8. A rock-breaking implement, preferably for a self-propelled percussive machine for driving boreholes, comprising a body whereof at least a part facing a borehole face is cylindrical in shape;

rock-breaking wedges on said body arranged in such a manner that blades of the wedges extend radially at an end face of said body facing the borehole face;

a plurality of grooves in said body which open outside to the periphery of said body to remove broken rock, said grooves being arranged in pairs extending along lefthand and righthand helical lines having an equal pitch, with the grooves of each pair intersecting one another in such a manner that portions of said body located between said pairs of intersecting grooves define said rock-breaking wedges;

edges of said rock-breaking wedges, which extend on the periphery of said body within the cylindrical part thereof defining a continuous circle when projected to a plane of transverse section of said body and forming walls of the borehole.

9. A rock-breaking implement according to claim 8, wherein the end face of said body with rock-breaking wedges is provided with an axially extending rock-breaking rod.

10. A rock-breaking implement according to claim 8, wherein passages for blasting the borehole face are provided in said body.

11. A rock-breaking implement according to claim 8, having additional wedges, each being defined by mutually inclined intersecting grooves beyond the point of their intersection, looking away from the borehole face, and extending between said rock-breaking wedges.

12. A rock-breaking implement according to claim 11, wherein the end face of said body with rock-breaking wedges is provided with an axially extending rock-breaking rod.

13. A rock-breaking implement according to claim 11, wherein passages for blasting the borehole face are provided in said body.

* * * * *